United States Patent [19]

Mason

[11] 4,124,210

[45] Nov. 7, 1978

[54] GOLF PUTTING PRACTICE APPARATUS

[76] Inventor: Herbert B. Mason, 456 Park Blvd., Worthington, Ohio 43085

[21] Appl. No.: 818,565

[22] Filed: Jul. 25, 1977

[51] Int. Cl.[2] ..... A63B 69/36

[52] U.S. Cl. ..... 273/176 F; 273/177 R

[58] Field of Search ..... 273/177 R, 177 A, 177 B, 273/180, 200 R, 208, 186 R, 176 F, 176 FA, 176 FB, 176 B, 176 E, 176 G, 87.2, 87.4, 87 R, 87 C, 87 H

[56] References Cited

U.S. PATENT DOCUMENTS

| | | | |
|---|---|---|---|
| 1,427,538 | 8/1922 | Long | 273/186 R |
| 3,342,495 | 9/1967 | Wasley | 273/180 X |

FOREIGN PATENT DOCUMENTS

| | | | |
|---|---|---|---|
| 3,837,767 | 11/1932 | United Kingdom | 273/186 R |

*Primary Examiner*—George J. Marlo
*Attorney, Agent, or Firm*—Mahoney & Stebens

[57] ABSTRACT

A golf putting practice device is provided including an elongated base sheet of material forming a putting surface and a pair of retaining walls adapted for assembly with the putting surface sheet. The putting surface or base sheet is formed with slots configured to maintain the retaining walls in a desired relative position to the putting surface. Each of the two retaining walls is formed from a flexible material that can be formed into the desired configuration and include an integrally formed upstanding wall member and base flange. When the retaining walls are assembled with the base sheet, the base flange underlies the putting surface and the walls project upwardly through the respective slots. The one retaining wall is of a key-hole type configuration providing a degree of retention for a golf ball and thus simulates the cup of a putting green. A second wall is configured in a semi-circle in surrounding relationship to the first wall and functions to retain a golf ball that misses the keyhole cup and prevents movement of the ball off from the base sheet surface.

16 Claims, 5 Drawing Figures

GOLF PUTTING PRACTICE APPARATUS

BACKGROUND OF THE INVENTION

This invention is directed to a device which enables a golfer to practice putting indoors in a room of a building such as a residence or office. People who are intensely interested in the game of golf, often desire to continue practice of certain aspects of the game, specifically, putting. This aspect of the game does not require that a person utilize a regulation type course and thus putting may be coveniently practiced throughout the year regardless of the weather conditions or the proximity of a golf course.

Many types of practice devices for golf putting have been heretofore devised, however, none have been determined completely suitable or to adequately simulate the actual golf putting conditions. Most devices heretofore fabricated and commercially marketed, include a device which is merely positioned on a carpeted floor and thus results in a device that requires an up-hill maneuvering of the ball to achieve the objective of positioning the ball in a cup simulating device. Furthermore, the devices do not include a cooperative wall arrangement that serves to collect or retain a ball which misses the cup-simulating device and results in substantial effort in retrieving the balls even in a room size arrangement.

SUMMARY OF THE INVENTION

In accordance with this invention, a golf putting practice device is provided which includes an elongated base sheet formed of material such as a carpeting material, and two retaining wall elements which are adapted to be assembled with the base sheet in retained relationship thereto. The base sheet has a carpet-type putting surface and is preferably formed from a material which has a surface characteristic that closely simulates a turf or grass surface such as that which is normally encountered on a regulation golf course. The retaining walls are assembled in slots formed in the one end portion of the base sheet. Each of the retaining walls is designed to be secured in this assembled relationship by means of devices which underlie the surface of the base sheet. Additionally, the retaining walls are of a relatively flexible material and thus may be readily configured to the shape of the slots that are thus formed in the base sheet.

The advantage of this arrangement is that the two retaining walls are relatively positioned and configured to simulate the cup arrangement and to also restrict the movement of golf balls that miss the cup. The one retaining wall is specifically configured into a keyhole shape which simulates the cup and advantageously serves to retain the ball that enters the open end of the slot thereof. The other retaining wall is of a configuration such that it will effectively retain a ball that misses the keyhole-shaped retaining wall and generally prevent a missed shot from being deflected in a return direction towards the player to a position where the ball may block or interfere with subsequent shots. The structural arrangement of the retaining walls is such that they do not materially alter the surface of the base sheet and thus result in a substantially planar surface that does not affect the rolling action of the ball and therefore more closely simulates actual playing conditions.

The device is formed from materials that are flexible and thus permit compact storage and transport. The elongated base sheet may be rolled into a compact cylinder for convenience of packaging and the flexible retaining walls may also be compactly coiled.

While the device of this invention is intended for substantial use in individual practice sessions, the device will be seen to have considerable value as a multiple player game. For example, two or more players may either sequentially putt for a specified number of strokes or each player may take a consecutive series of a specified number of strokes. The player holing the most putts and not matched by another player would win a game comprising a specified number of strokes.

These and other objects and advantages of this invention, will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
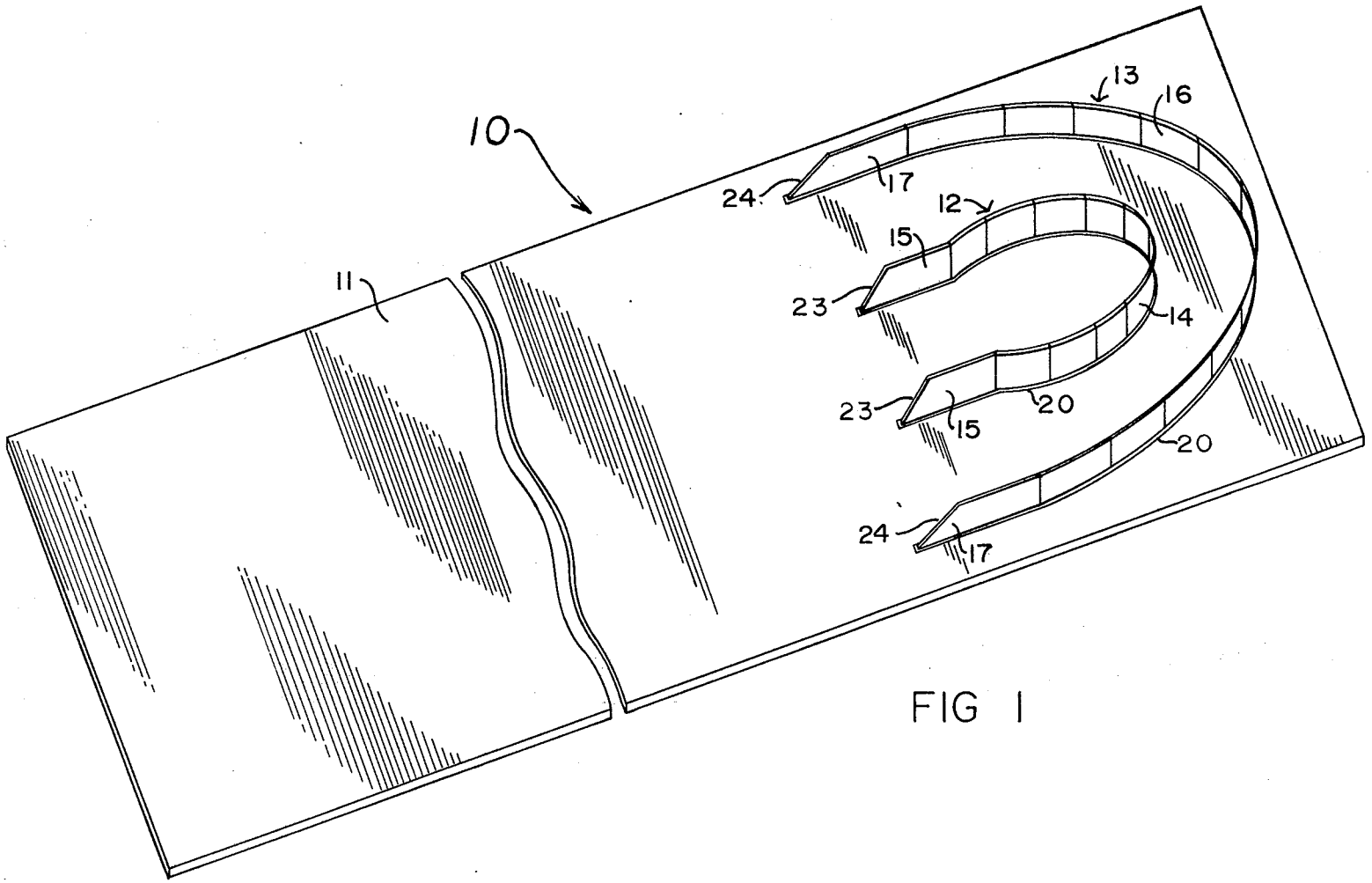
FIG. 1 is a perspective view of a golf putting practice device embodying this invention.

Having reference specifically to FIG. 1 of the drawings, a golf-putting practice device embodying this invention is illustrated in perspective as positioned on a supporting structure such as a floor. The device, indicated generally by the numeral 10, includes an elongated base sheet 11 and two retaining walls 12 and 13. The base sheet 11 is formed from a flexible material having an upper surface which is particularly adapted to rolling of a golf ball thereover in simulation of the surface of a putting green. This sheet may be advantageously formed from a material such as a carpet having a close pile that closely simulates a grass or turf surface. The specific material utilized and the surfacing of the sheet is determined by the particular characteristics deemed appropriate for a specific dimensioned size of such a device. Accordingly, there may be a substantial variation in the specific construction of the base sheet and the related characteristics with respect to the rolling of a golf ball as produced in a putting stroke. As an example of the size of this device, the base sheet 11 may be of a width of two feet and of a length of from ten to fifteen feet. As indicated, these dimensions are by way of example and not considered limitative of the invention.

Figure 2:
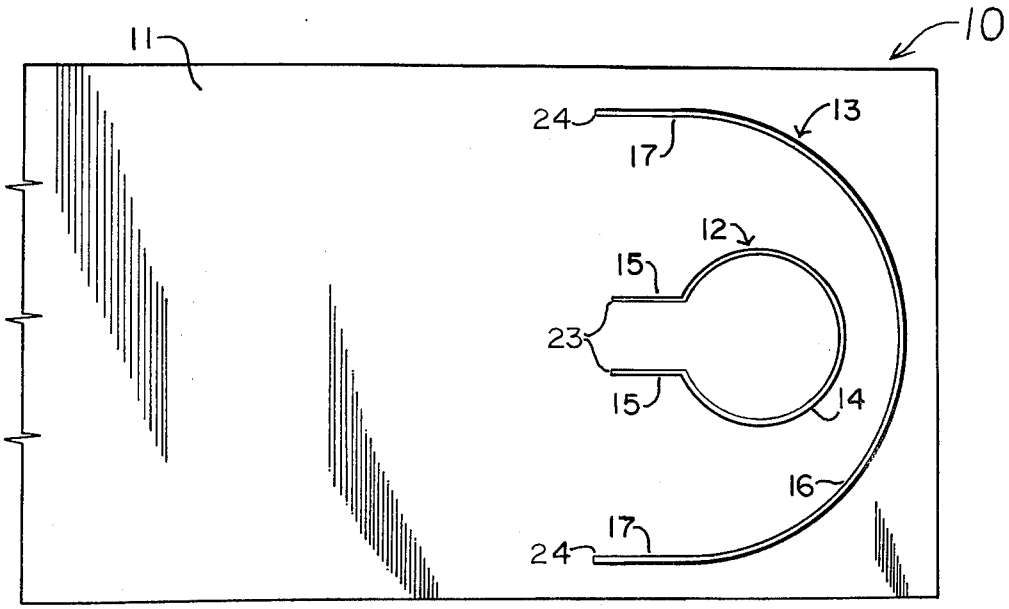
FIG. 2 is a top plan view of a fragmentary end portion of the device.

In accordance with this invention, the two retaining walls 12 and 13, are held in assembled relationship with the elongated base sheet 11, at one marginal end portion thereof, by novel support means. The specific structure of each retaining wall and its associated support means will be described in substantial detail hereinafter but it will be noted in FIG. 1, and also in the enlarged plan view of that marginal end portion in FIG. 2, that the two walls 12 and 13 are configured to form a key hole shaped wall structure and a semi-circular wall structure, respectively. Each of the two walls 12 and 13 are oriented as can be seen in FIGS. 1 and 2, to position and place the respective opening in each wall facing in a direction toward the opposite end of the base sheet 11. This arrangement thus enables one to direct a golf ball longitudinally along the sheet 11 with the desired objective of causing the ball to enter the open end of the retaining wall 12 which is specifically designed to simulate the effect of a cup on a golf green. Referring specifically to FIG. 2, the retaining wall 12 is seen to include a primary section 14 which is of a circular shape and terminating in end portions 15 that project longitudinally with respect to the sheet 11 in spaced parallel relationship. Preferably, this wall 12 is oriented such that the two parallel end potions 15 are spaced equidistantly at opposite sides of the center longitudinal axis of the elongated sheet 11 with this spacing preferably being substantially less than the standard 4¼ inch cup diameter to compensate for the improved surface condition.

The other retaining wall 13, which is disposed in a semi-circular arrangement, includes an arcuately curved portion 16 which is oriented with the open end thereof facing toward the opposite end of the base sheet. As in the case of the key-hole retaining wall 12, the arcuately curved portion 16 is also provided with terminal end portions 17 that are relatively straight and spaced parallel to each other. It will also be noted that the retaining wall 13 is relatively positioned to substantially enclose the key hole retaining wall 12 and is symmetrically oriented with respect to a central longitudinal axis of the elongated sheet. To conserve space and better cooperate with the first retaining wall 12, the semi-circular wall 13 is not necessarily symmetrically positioned with respect to the circular section 14. It is only essential in this respect that the space between the two walls be greater than that of a golf ball to permit passage of the ball between these two walls in a circular, rolling movement with respect to the base sheet.

The two retaining walls 12 and 13 are fabricated in similar manner and include an upstanding wall member 18 and associated support means 19. This configuration and functioning of the upstanding wall member and associated support means 19 is the same with respect to either of the retaining walls 12 and 13 and thus this description is applicable to either wall. It will be noted, however, that the specific illustration of FIGS. 3 and 5 pertains to the keyhole shaped retaining wall 12 and it will be further noted that the assembly of each wall, with the base sheet 11, is effected in the same manner. This assembly of the two retaining walls 12 and 13 with a base sheet 11 is advantageously accomplished through the interlocking relationship of the wall positioned in a slot 20 which is formed in the base sheet 11 at the illustrated positions of FIGS. 1 and 2 and configured to correspond with the respective desired retaining wall shape.

Each of the retaining walls 12 and 13 is preferably formed from a plastic material having a requisite degree of flexibility to permit flexing of the wall into the desired arcuate shape and subsequent assembly with the respective slot 20. Also, as can be best seen in FIG. 5, each upstanding wall member 18 is integrally formed with a support means 19 that comprises a horizontally disposed flange 21. Each of the upstanding wall members 18 is of a vertical height that is slightly greater than the one-half diameter of a golf ball. This arrangement and relative size is illustrated in FIG. 5 and in a preferred embodiment of the invention, this upstanding wall has a vertical dimension of one and three eighths inches. The wall 18 is preferably three-thirty seconds inch thick while the flange 21 is one-sixteenth inch thick to facilitate rolling into a compact storage configuration. The flange 21 has a total width of two inches and is symmetrically oriented with respect to the wall member 18 throughout the entire length of each respective wall 12 or 13. This symmetrical orientation is readily seen in FIGS. 3, 4 and 5 with respect to each of the two retaining walls. It will also be noted that the upstanding wall members 18, as to each wall 12 and 13, are linear except with the flanges 21 being formed in a number of relatively short segments in order that each wall will very nearly assume a desired circular or arcuate configuration of the respective slots. The terminal end portions 15 and 17 each comprise single segments since they do not have a requirement to conform to a curved line or slot.

Fabrication of each of the walls 12 and 13 may be readily accomplished by suitable molding techniques employed in the plastic industry and results in a unitary, integrally formed structure that is self-supporting when positioned on a base surface and is particularly adapted for interlocking with the base sheet 11. It will be noted in FIGS. 3 and 4 that the flange 21 for each wall includes a series of substantially linear elements or sections that are not interconnected except as by the hinging effect of the respective upstanding wall member 18. Preferably, the ends 22 of each section of the flange sections 21, are configured to be relatively divergent to thus enable the flange 21 to also bend into conformity with the arcuate configuration of the respective slots.

It will also be noted in FIG. 1 that the terminal and portions 15 and 17 of each respective wall 12 and 13, includes an extreme end edge 23 and 24 that is angled downwardly with respect to the bottom edge of the upstanding wall or to the flanges 21. This downwardly angled edge of the walls is advantageous in that any golf ball which should contact the end portion of such a flange, will not likely be stopped at that point or returned in an opposite direction due to rebound, but will preferably be deflected to one side or the other of the wall.

Figure 4:
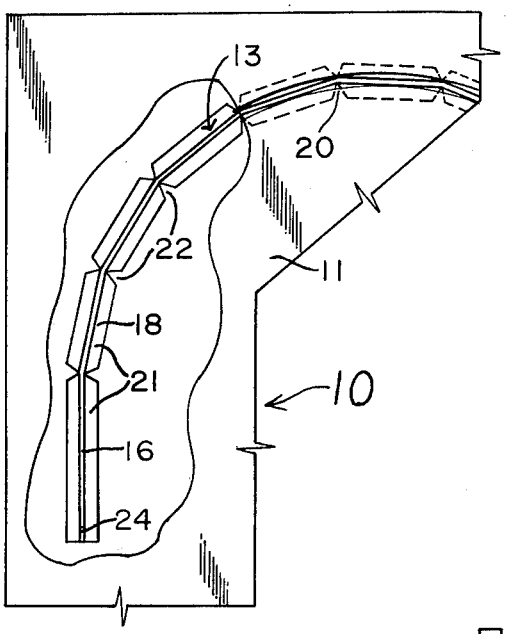
FIG. 4 is a fragmentary top plan view on a substantially enlarged scale of a portion of the device including the outer retaining wall.
Figure 3:
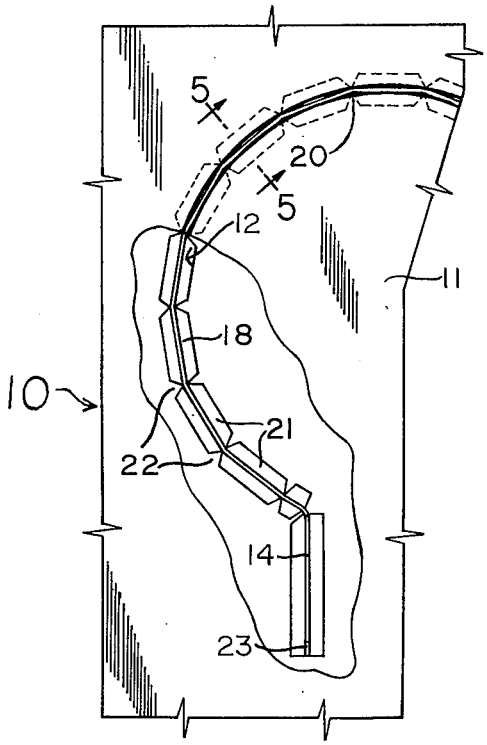
FIG. 3 is a fragmentary top plan view on a substantially enlarged scale of a portion of the device including the key hole slot retaining wall.
Figure 5:
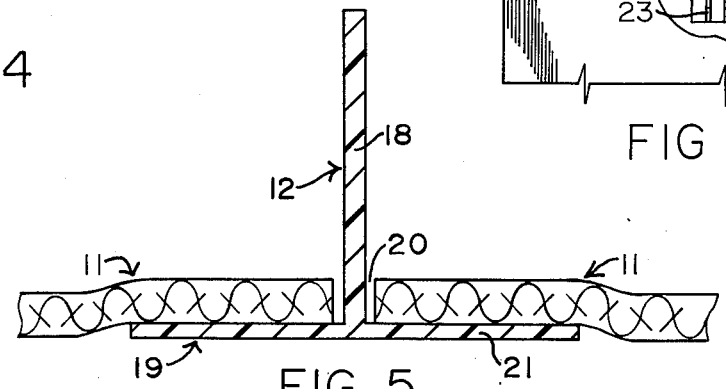
FIG. 5 is a fragmentary vertical sectional view on a substantially enlarged scale taken along line 5—5 of FIG. 3.

Assembly of each retaining wall 12 and 13 with the base sheet 11 is best illustrated in FIGS. 3, 4 and 5. The person utilizing the device first positions the base sheet 11 on a suitable supporting surface as a floor, and when thus positioned, places the respective retaining walls 12 and 13 in the respective slots 20. This is readily accomplished in that the potions of the base sheet circumscribed by the respective slots may easily be picked up and thus enable one to position the retaining walls with the flanges 21 resting on the floor surface. The flexibility of the retaining walls enables the wall to be bent and manipulated to the necessary extent so as to enable one to insert the outwardly directed portions of each flange under the associated marginal edge portion of the base sheet. Once the walls 12 and 13 have been positioned in an opening defined by a respective slot 20, the interior portions of the base sheet 11 may then be replaced in the essentially planar configuraion and complete the interlock of the retaining wall with the base sheet.

Referring to FIG. 5, it will be seen that the carpet is of a thickness of the order of about three sixteenth of an inch and thus does not present a substantial difference in the total heigth of the upper surface of the base sheet 11 in any area adjacent the retaining walls which would adversely affect the rolling or direction of a golf ball. The width of the flanges 21 is limited and the flanges do not extend any substantial distance from the side of the upstanding wall member and thus will not cause the adjacent marginal edge portion of the base sheet 11 to be elevated to any appreciable extent as to effect the movement of a golf ball closely adjacent the wall. The weight and effect of the base sheet 11 overlying the flanges 21 cooperates therewith in aiding and assisting the retaining walls 12 and 13 to maintain the desired upright configuration. The combined effect of the width of flange 21 and the weight of the overlying base sheet 11 is such that it will effectively counteract the rolling mementum force that is normally induced in golf balls during the golf putting practice.

In the utilization of this golf putting practice device, a person would normally stand at the end of the base sheet 11 opposite that portion which is assembled with the retaining walls 12 and 13. Positioning of the golf ball on the upper surface of the base sheet 11 at this location, or at a closer position, will result in simulation of a putting stroke with the ball being propelled in a desired direction toward the open end of the straight end portions 15 of the retaining wall 12. A person will thus be provided with an indication of his technique in putting. The shape of the retaining wall 12, being in the form of a keyhole, is of particular advantage in that subsequent to the entry of a golf ball through the opening between the two end portions 15, the ball will tend to remain within the circular section 14. It will also be noted that the circular area encompassed by the wall section 14 is sufficiently large to permit entry and retention of several balls thereby permitting several consecutive successful strokes before necessitating recapture of the balls. Also, the height and flexibility of the walls 12 and 13 are designed to result in a ball jumping over a wall if the putting force exceeds that which is appropriate to better simulate sinking of a ball in a regulation cup.

If the ball should miss the open ends 15, of the keyhole wall 12 then the ball may enter the space between the two walls 12 and 13 and ultimately strike the wall 13. Upon striking the wall 13, the ball will then be directed in an arcuate manner around the wall and will probably be retained within this area where it will not interfere with subsequent strokes in attempting to place a ball in the area of the key-hole wall 12. The total effect of this arrangement is that a ball which misses the key hole shaped and cup simulating retaining wall will normally at least enter the area described by the open end of the retaining wall 13 and thus minimize the chance of a ball going astray and become difficult to retrieve in a room area, such as being lost under other items of furniture.

Upon completion of use, the device may be readily stored in a small compact configuration and, perhaps, reinserted in a suitable container. The disassembly is effected in substantially the same manner with the end of the base sheet 11 being picked up at the marginal end portion including the slots 20 to permit removal of the retaining walls 12 and 13. The base sheet 11 may then be readily rolled into a cylindrical shape and the two retaining walls then either placed within or into the rolled base sheet or appropriate container for purposes of storage. It is contemplated that a transparent container or wrapping may be advantageously used to enhance visibility of the device and better induce sales in a store.

It will be readily apparent that a particularly novel and advantageous golf putting practice device is provided by this invention and includes a novel method of interlocking the retaining walls 12 and 13 with a base sheet. This structure is of particular advantage in that it is capable of effectively resisting the forward momentum of a golf ball in such practice and is fully operative to retain the ball on the base sheet. The configuration is such that the ball will be readily retained in the one retaining wall which simulates the cup and thus adds to the realism of the practice. The flexibility of the retaining walls greatly facilitates the storage of the device and initial packaging to better display the device thereby enhancing marketability.

Having thus described this invention, what is claimed is:

1. A golf-putting practice device comprising an elongated sheet of flexible material having an upper surface adapted to rolling of golf ball thereover when said sheet is positioned on a suitable floor in a substantially horizontal plane, said sheet having formed in one marginal end portion thereof an elongated slot of arcuate configuration with the ends of said slot spaced a predetermined distance apart, said slot being of a configuration defining a substantially closed loop which opens in the direction of the opposite end of said elongated sheet, and an elongated retaining wall formed from a flexible material selectively and removably positionable in said slot in assembled relationship with said elongated sheet, for maintaining said wall in the configuration of said slot and having an opening to permit passage of a golf ball therethrough when assembled with said sheet, said retaining wall being formed with an upstanding wall member and support means provided at a bottom edge of said upstanding wall member for cooperatively interengaging with said sheet for maintaining said wall member in upstanding relationship to a floor, said upstanding wall member being of a height to extend a sufficient distance above said sheet to stop a golf ball rolling on said sheet.

2. A golf-putting practice device according to claim 1 wherein said retaining wall support means includes base elements projecting a distance laterally outward from said upstanding wall member to underlie adjacent marginal edge portions of the sheet at said slot.

3. A golf-putting practice device according to claim 2 wherein said support means base elements are planar flanges.

4. A golf-putting practice device according to claim 3 wherein said flanges are integrally formed with said upstanding wall member.

5. A golf-putting practice device according to claim 4 where said flanges are of a thickness substantially less than the thickness of said elongated sheet.

6. A golf-putting practice device according to claim 2 wherein said support means base elements project laterally outward from both sides of said upstanding wall member.

7. A golf-putting practice device according to claim 1 wherein said slot is of a width substantially equal to the thickness of said upstanding wall member.

8. A golf-putting practice device according to claim 1 wherein said support means includes base elements integrally formed with said upstanding wall member.

9. A golf-putting practice device according to claim 8 wherein said base elements include a plurality of planar flanges extending a distance laterally outward from both sides of said upstanding wall member.

10. A golf-putting practice device according to claim 9 wherein said planar flanges are of a length and number so that said upstanding wall member will closely approximate a preformed arcuate curvature that is the same as the curvature of said slot.

11. A golf-putting practice device according to claim 10 wherein said flanges are discontiguous from one another.

12. A golf-putting practice device according to claim 1 with a plurality of elongated retaining walls and said elongated sheet is formed with a plurality slots for receiving respective ones of said retaining walls.

13. A golf-putting practice device according to claim 12 wherein one of said retaining walls and associated slot are of a semicircular configuration having an open end facing toward the opposite end of said sheet, said one retaining wall substantially enclosing the other of said retaining walls.

14. A golf-putting practice device according to claim 13 wherein said other retaining wall and associated slot each terminate in spaced parallel end portions aligned with a longitudinal axis of said sheet.

15. A golf-putting practice device comprising an elongated sheet of flexible material having an upper surface adapted to rolling of a golf ball thereover when said sheet is positioned on a substantially planar, horizontal supporting surface, said sheet having formed in one marginal edge portion thereof a pair of elongated slots of predetermined configuration and spaced a distance apart, a pair of elongated retaining walls selectively positionable in respective ones of said pair of slots in assembled relationship with said elongated sheet, each of said retaining walls being formed with an upstanding wall member of a height to extend a sufficient distance above said sheet to stop a golf ball rolling on said sheet and support means provided at a bottom edge of the upstanding wall member for maintaining said wall member in upstanding relationship to said sheet, a first one of said slots and respective retaining wall being of semicircular configuration having an open end facing toward the opposite end of said sheet and disposed in transverse relationship to a longitudinal axis of said elongated sheet, the second one of said slots and respective retaining wall includes an arcuately curved portion of circular configuration having an opening facing toward the opposite end of said sheet adapted for passage of a golf ball therethrough and a pair of spaced parallel end portions connecting with said arcuately curved portion at opposite sides of the opening thereto, with said end portions spaced apart a distance sufficient to permit passage of a golf ball therethrough but substantially less than the diameter of said arcuately curved portion, said parallel end portions disposed parallel to and equidistantly spaced with respect to an extended diametrical axis of said arcuately curved portion and to the longitudinal axis of said sheet, the second one of said slots and retaining wall disposed substantially within the area defined by the first one of said slots and retaining wall.

16. A golf-putting practice device accoding to claim 15 wherein the wall member of each of said retaining walls is formed with an edge surface at each respective end that is upwardly tapered from the bottom of the wall member in a direction relatively inward in the plane of the wall member.

* * * * *